United States Patent [19]

Steiner

[11] Patent Number: 4,771,895

[45] Date of Patent: Sep. 20, 1988

[54] TELESCOPIC CLOTHES DRIER

[76] Inventor: Walter Steiner, Santisstrasse 52, CH-8311 Brutten, Switzerland

[21] Appl. No.: 71,093

[22] Filed: Jul. 8, 1987

Related U.S. Application Data

[63] Continuation-in-part of Ser. No. 806,282, Dec. 6, 1985, abandoned.

[51] Int. Cl.[4] ..... A47B 53/00

[52] U.S. Cl. ..... 211/1.3; 211/105.3

[58] Field of Search ..... 211/1.3, 172, 175, 4, 211/6, 87, 105.3

[56] References Cited

U.S. PATENT DOCUMENTS

| | | | |
|---|---|---|---|
| 398,811 | 2/1889 | Worthington | 211/1.3 |
| 2,562,982 | 8/1951 | Cieri | 211/1.3 X |
| 3,612,284 | 10/1971 | Stoltz | 211/1.3 |
| 3,784,020 | 1/1974 | Steiner | 211/1.3 |
| 4,204,601 | 5/1980 | Thomas | 211/4 |
| 4,632,255 | 12/1986 | Kennedy | 211/1.3 |

*Primary Examiner*—J. Franklin Foss
*Assistant Examiner*—Sarah A. Lechok Eley
*Attorney, Agent, or Firm*—Tarolli, Sundheim & Covell

[57] ABSTRACT

A telescopic clothes drier comprises two telescopic arms of which is formed of a plurality of slides. The slides have bearing stubs thereon for receiving the ends of clothes supporting rods extending between the telescopic arms. All of the slides except the foremost one have cut-out slots for receiving respective clothes supporting rods when the telescopic arms collapse. A hood extends between the two telescopic arms and is pivotally suspended on the two rearmost wall-side slides. The hood covers the clothes supporting the rods which are located in the zone of the slots of the two rearmost wall-side slides.

10 Claims, 4 Drawing Sheets

TELESCOPIC CLOTHES DRIER

This application is a continuation-in-part of application Ser. No. 806,282 filed Dec. 6, 1985, now abandoned.

BACKGROUND AND SUMMARY OF THE INVENTION

The invention relates to a telescopic drier for clothes with two telescopic extendable arms between which clothes supporting rods extend.

Various designs of driers for clothes which arms can be extended and pushed together telescopically are already known and have been available on the market for years. When such a drier is in a fully extended position and is loaded with wet and thus relatively heavy clothes, a large strain on the telescopic arms is to be expected. However, it is desirable that the operation of such a drier can be performed without efforts and reliably. Several elements of the telescopic arms should always be perfectly guided despite the heavy load so that they can be easily pushed or extended without the sagging or sticking of the several parts.

In one clothes drier of this kind, which is described in U.S. Pat. No. 3,784,020, these problems have been solved quite satisfactorily, and such clothes drier has proved to be quite good in practical operation for a long time. A disadvantage of this clothes drier consists in that the clothes supporting rods for freshly washed clothes tend to get soiled even when the clothes drier is in a rest, collapsed condition. Another disadvantage of such a clothes drier consists in that the transition of the same from the rest position to the condition ready for use, takes place more or less without control. Particularly, in a case of uneven actuation, for example, extending only one telescopic arm, the danger exists that the individual elements of the telescopic arm will be tilted and damaged. This disadvantage is negated when it is intended to use the whole capacity of the clothes drier, that is, when it is fully extended and when the two telescopic arms are evenly extended together. But very often there exists a need for the clothes drier to be used only partially, that is, when only one clothes supporting rod or a few of the available clothes supporting rods are to be used. However, the objects of the least possible space requirement and protecting the clothes supporting rods which are not used against soiling cannot be attained in the clothes drier according to U.S. Pat. No. 3,784,020, or can be attained only partially when substantial efforts are employed.

The object of the present invention, therefore, is to improve or further develop a clothes drier of the kind mentioned, so that, while retaining the time-tested advantages, it can also be attained that, on one hand, the unused clothes supporting rods are always protected against soiling, and, on the other hand, in an exactly definite way, only a portion of the whole clothes drier can be used by extending of an exact number of individual clothes supporting rods, and in which clothes drier the danger of tilting of the elements of the telescopic arms is substantially reduced.

BRIEF DESCRIPTION OF THE DRAWINGS

Herebelow is a detailed description of preferred embodiments of a clothes drier according to the present invention with reference to the attached drawings wherein.

DESCRIPTION OF THE PREFERRED EMBODIMENTS

Figure 1:
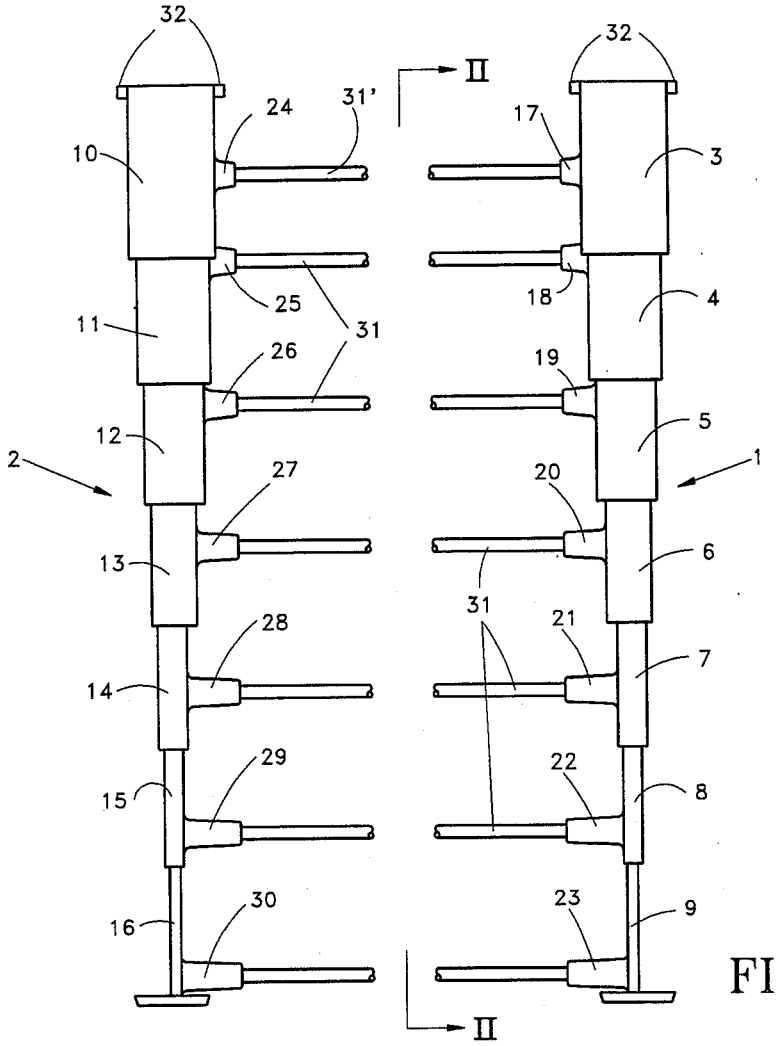
FIG. 1 is a top schematic view of an embodiment of the clothes drier according to the present invention with telescopic arms in an extended condition.

In FIG. 1, a clothes drier is shown schematically in an extended condition. It has two telescopic arms 1 and 2, the telescopic arm 1 comprising a number of slides 3 to 9, and the other telescopic arm 2 comprising an equal number of slides 10 to 16. The number of slides can be selected in accordance with the desired receiving capacity of the clothes drier.

At the side of each slide are arranged bearing stubs 17 to 30 for supporting the free ends of respective clothes supporting rod 31. Each two corresponding slides, that is, two opposite slides, for example, slides 3 and 10, or slides 4 and 11, or slides 5 and 12, etc., form together with respective clothes supporting rod 31 a fixed unit by which the stability of the telescopic arms 1 and 2 is increased.

The slides 3 to 9 and 10 to 16 are provided with openings so that they can be pushed together. Those slides which receive an adjacent slide have a rectangular hollow profile. As can be seen, particularly in FIG. 2, in a side wall of the slides 3–8, slots 33 to 38 are cut out for receiving the bearing stubs 18 to 23 when the telescopic arm 1 is collapsed. Correspondingly, the slides 10 to 15 are also provided with slots (not shown in the drawings) for receiving the bearing stubs 25–30 when the telescopic arm 2 is collapsed.

Figure 2:
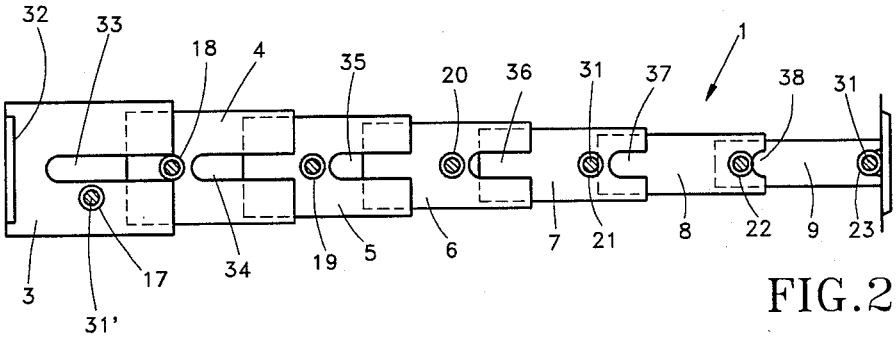
FIG. 2 is a section along the lines II—II of FIG. 1.

As seen in FIG. 2, the slots have unequal lengths; the slot 38 receives only one clothes supporting rod 31, while the slot 37 must have a length sufficient to receive two clothes supporting rods 31. The slot 36 must have a length sufficient to receive three clothes supporting rods 31, etc. In this way it is achieved that the two telescopic arms 1 and 2 can collapse to a minimal length corresponding only to the length of the rearmost wall-side slides 3 and 10, respectively. The rearmost wall-side clothes supporting rod 31' held by the bearing stubs 17 and 24 on the slides 3 and 10 remains stationary and is, therefore, displaced downward to permit a slight depth expansion of the clothes drier in the rest position.

The two stays 32 on the rearmost wall-side slides 3 and 10 serve for mounting the two telescopic arms 1 and 2 in holding elements (not shown) which are fastened, for example, to a wall which is not shown in detail. By locating the bearing stubs 17 and 24 of the slides 3 and 10 below the slots 33, sufficient distance from the wall for hanging the clothes is provided.

The structure of a clothes drier, time-tested per se, is now improved according to the invention by providing a hood extending between the two telescopic arms 1 and 2, and which is essentially L-shaped in cross section. In FIGS. 3 to 6, this hood is indicated in general by a reference numeral 39.

The hood 39 preferably is made of an L-shaped profile of aluminum sheet and includes an upper leg 40 and a front leg 41, the two legs 40 and 41 forming therebetween an angle of about 90°. The hood 39, in the zone of the two free rear corners of the upper leg 40 is pivotally fastened to tne two rearmost wall-side slides 3 and 10, the respective pivoting axes being marked by a reference numeral 42 in FIGS. 4 to 6. This pivoting support may be effected in any suitable way, known per se, so that it need not be discussed in detail here.

The two slides 3 and 10 are also equipped with stops 43 (see FIG. 6) which are located on inside surfaces opposite each other of the box profile of the slides and against which the front edge of the upper leg 40 of the hood 39 rests. This arrangement assures that all clothes rods 31 are located in the zone of the rearmost slides 3 and 10, respectively, that is, they are introduced into the slots 33 and are covered by the hood 39, and thus, effectively protected against soiling.

Figure 3:
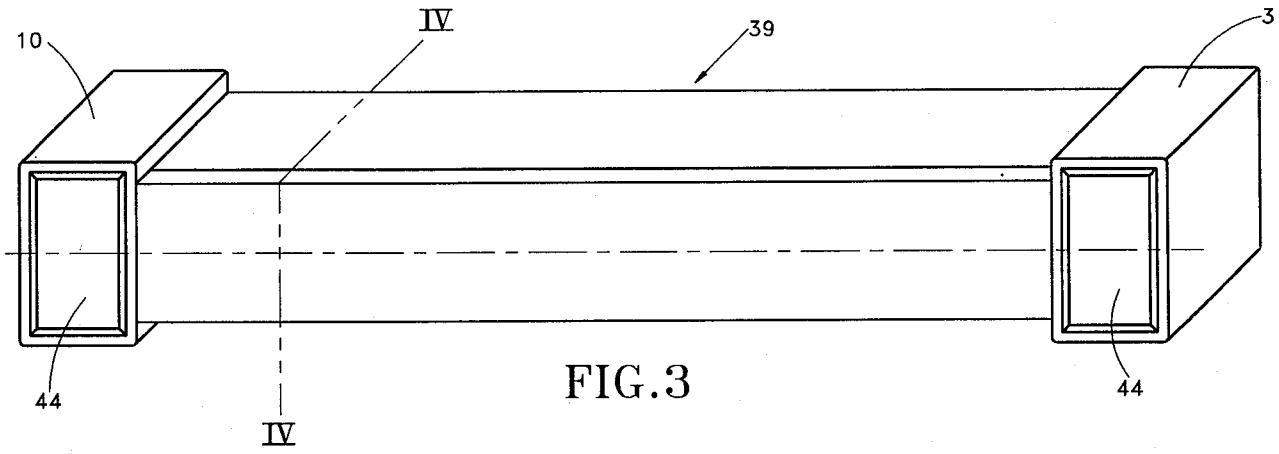
FIG. 3 is an exploded schematic view of a first embodiment of the clothes drier in the rest position with telescopic arms in collapsed condition.
Figure 4:
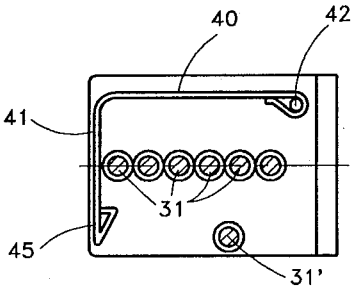
FIG. 4 is a section along the lines IV—IV of FIG. 3.

This can be clearly seen in FIG. 4, which shows a section along the line IV—IV in FIG. 3. FIG. 3 also makes clear that the clothes drier of the invention in the collapsed condition, that is, with the telescopic arms 1 and 2 completely pushed in, forms a compact, attractive unit, protected against dust and other soiling. Contributing to this are the cover plates 44 located at the end on the foremost slides 9 and 16 and which width and height correspond approximately to the width and height of the rearmost wall-side slides 3 and 10. Thus, the mainly open front side of the rearmost slides 3 and 10 with the telescopic arms 1 and 2 collapsed is also covered so that the inside is protected against soiling.

It has proved advantageous to make the hood 39 of aluminum sheet or plastic, not only because this is an easy-to-work and corrosion-resistant material but also because an attractive exterior can easily be obtained, possibly by coloring or, in the case of aluminum, by anodic oxidation. It is obvious, however, that other suitable materials may be used, for example, steel sheet, etc.

Figure 5:
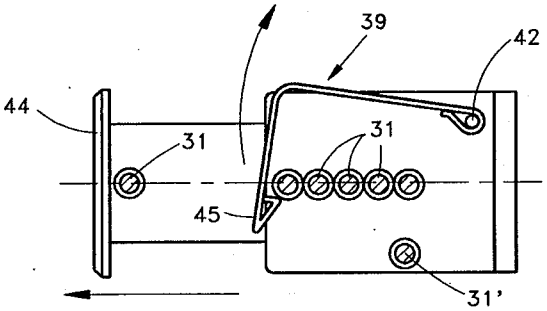
FIG. 5 is a section of the clothes drier according to FIG. 3 in a first phase of use.
Figure 6:
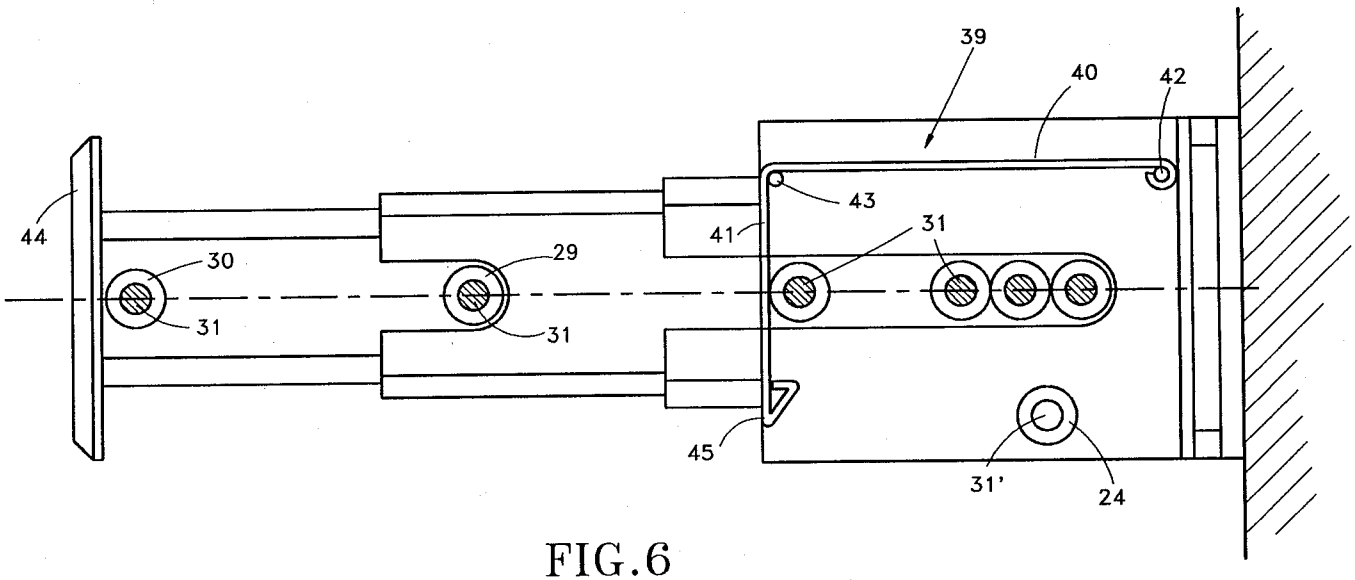
FIG. 6 is a sectional side view on a large scale of the same clothes drier which is partially extended.

The hood 39 is provided, along the free lower edge of the front leg 41, with a padding 45 of triangular cross section directed inward, which may consist, for example, of a flange inwardly directed, end portion of the leg 41. This padding 45, on one hand, secures the hood 39 in the rest position, as shown in FIGS. 3, 4 and 6; and on the other hand, the padding 45 prevents a flapping up, by mistake, of the hood 39, since, as we know, a gripping of the padding 45 over the foremost clothes rod 31, must be caused by elastic deformation of the hood 39, as indicated in FIG. 5, with hood 39 partially turned up.

The hood 39 not only serves the purpose of protecting unused clothes supporting rods against soiling; it is also designed to support a partial extension of the clothes drier into a desired use position. In the view shown in FIG. 6, there is a position in which only the foremost clothes supporting rods 31 have been extended for use. The next clothes supporting rod 31 lies against the inner surface of the front leg 41 of the hood 39, so that no further extension of the telescopic arms 1 and 2 is possible. In this way, it is assured that the clothes drier that occupies minimal space the exact desired capacity, while at the same time, the unused clothes supporting rods 31 are protected against soiling.

It is further attained in this way that the clothes drier, that is, the two telescopic arms, can only be extended a relatively small amount, since the hood, falling back into the rest position, prevents a further extension. During the slight extension distance of the telescopic arms, as released by the hood, no functioning-damaging tilting of the elements of the telescopic arms can occur, in practice, even when only one arm is extended. The directed downward tip of the triangular padding at the end of the hood still favors the separation of the clothes supporting rod lying in front to be pulled out next from the adjacent rod, when the hood is raised and released again, since this pointed tip will fall into the space between the foremost and the next clothes supporting rod.

Figure 7:
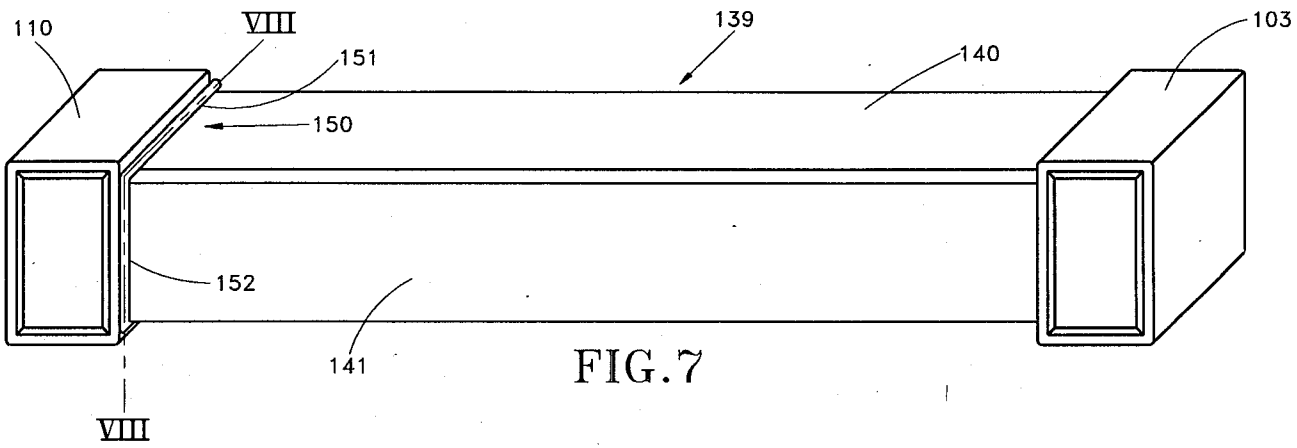
FIG. 7 is an exploded schematic view of a second embodiment of the clothes drier in the rest position with telescopic arms in collapsed condition.
Figure 9:
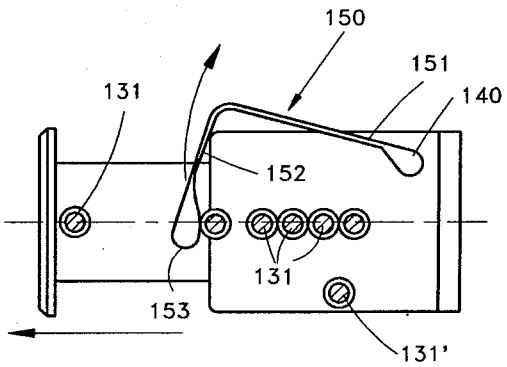
FIG. 9 is a section of the second embodiment of the clothes drier according to FIG. 7 in a first phase of use.
Figure 8:
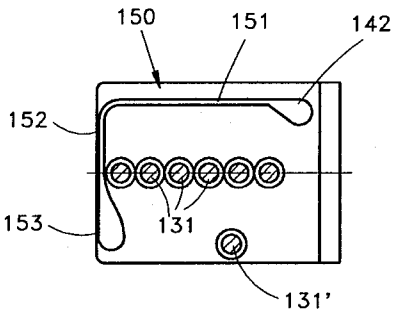
FIG. 8 is a section along the lines VIII—VIII of FIG. 7.

In FIGS. 7 to 9, there is shown a second embodiment of the clothes drier. It is basically similar to the first embodiment described hereinbefore and comprises a hood 139 including an upper leg 140 and a front leg 141, the two legs 140 and 141 forming therebetween an angle of about 90°. The hood 139, in the zone of the two free rear corners of the upper leg 140, is pivotally fastened to the two rearmost wall-side slides 103 and 110, the respective pivoting axes being marked by a reference numeral 142 in FIGS. 8 and 9.

The two side edges of the hood 139 which extend besides the two rearmost wall slides 103 and 109, respectively, are equipped each with generally L-shaped terminal members 150 made, e.g., of plastic material. In FIG. 7, only the left one, adjacent to slide member 110, can be seen. A leg portion 151 fits over the side edge of the upper leg 140 of the hood 139, and a leg portion 152 fits over the front leg 141 of the hood 139. The opposite edge portions of the hood 139, near the slide member 103, comprise a similar terminal member 150 (not shown).

As already mentioned in connection with the first embodiment, this arrangement again assures that all clothes rods 131 and 131' are located in the zone of the rearmost slides 103 and 110, respectively, that is, they are covered by the hood 139, and thus, effectively protected against soiling.

As can be seen from FIGS. 8 and 9, the two terminal members 150 comprise an enlarged portion 153 projecting towards the interior of the hood 139. The portions 153 of the two terminal members 150 receive the free ends of the padding 45 (see FIG. 4).

Similarly as in the first embodiment, the enlarged portions 153 of the terminal members 150 secure the hood 139 in the rest position as shown in FIGS. 7 and 8. On the other hand, the enlarged portions 153 of the terminal members 150 prevent a flapping up of the hood by mistake. However, if the telescopic arms are pulled out with a certain pulling force, the hood 139 will be elastically deformed as shown in FIG. 9, and the enlarged portions 153 of the terminal members 150 will slide over the frontmost clothes rod 131. This removes the need to grip the front leg 141 of the hood 139 and to elastically deform it in order to extend the telescopic arms.

In all other respects the second embodiment of the clothes drier is equal to the first embodiment and provides the same features and advantages.

Having described my invention, I claim:

1. A telescopic clothes drier comprising two spaced telescopic arms each of which includes a plurality of slides, a plurality of clothes supporting rods extending between the two telescopic arms, said slides being provided with bearing stubs for receiving the ends of clothes supporting rods, said slides telescoping into each other upon collapsing of the telescopic arms and said slides telescoping out of each other to extend the telescopic arms a desired amount, certain of said slides having slots for receiving respective clothes supporting rods upon collapsing of the telescopic arms, and a hood extending between the two telescopic arms and pivotably suspended on the rearmost slides of the two telescopic arms for covering the clothes supporting rods located in the slots of the rearmost slides and for preventing extension of the two telescopic arms in excess of the desired amount, said hood having two legs extending at a substantially right angle to each other to form an essentially L-shaped cross-section, one of said legs being an upper leg overlying the clothes supporting rods located in the slots of the rearmost slides to protect the same, and the other of said legs being a front leg movable into the path of extension of the telescopic arms to block the extension of the telescopic arms in excess of the desired amount.

2. A telescopic clothes drier according to claim 1, wherein said hood is formed of aluminum sheet or plastic, the width of the upper leg corresponds approximately to the length of the rearmost slides, and the width of the front leg corresponds approximately to the height of the rearmost slides.

3. A telescopic clothes drier according to claim 2, wherein said hood has an inwardly extending padding at the free end of its front leg.

4. A telescopic clothes drier according to claim 3, wherein the padding is formed from the end portion of the front leg and has an essentially triangular inwardly directed cross section.

5. A telescopic clothes drier according to claims 1, 2, 3 or 4, wherein at least one of the inner opposite surfaces of the rearmost slides is provided with a stop for the front end of said upper leg of said hood.

6. A telescopic clothes drier according to claims 1, 2, 3 or 4 wherein the front ends of the foremost slides are provided with cover plates the width and height of which corresponds to the width and height of the rearmost slides.

7. A telescopic clothes drier comprising two telescopic arms each of which includes a plurality of slides, a plurality of clothes supporting rods extending between the two telescopic arms, said slides being provided with bearing stubs for receiving the ends of clothes supporting rods, certain of said slides having slots for receiving respective clothes supporting rods upon collapsing of the telescopic arms, and a hood extending between the two telescopic arms, said hood having an essentially L-shaped cross-section and being pivotally suspended on the rearmost slides of the two telescopic arms for covering the clothes supporting rods located in the slots of the rearmost slides, said hood having an upper leg that extends between the rearmost slides and the width of which corresponds approximately to the length of the rearmost slides and a front leg the width of which corresponds approximately to the height of the rearmost slides and overlies the slots of the rearmost slides.

8. A telescopic clothes drier according to claims 1 or 2 further comprising an L-shaped terminal member overlying said hood, said L-shaped terminal member having a first leg that fits over the side edge of said upper leg of said hood and a second leg that fits over said front leg of said hood.

9. A telescopic clothes drier according to claim 8 wherein said hood has an inwardly extending padding at the free end of its front leg and said second leg of said L-shaped terminal member has an enlarged portion that fits over said padding.

10. A telescopic clothes drier according to claim 8 or 9 wherein said L-shaped terminal member is made of a plastic material.

* * * * *